US007343989B2

(12) United States Patent
Underwood

(10) Patent No.: US 7,343,989 B2
(45) Date of Patent: Mar. 18, 2008

(54) SECONDARY RETAINER FOR A DOWNHOLE HAMMER BIT

(75) Inventor: Lance D. Underwood, Cypress, TX (US)

(73) Assignee: Smith International, Inc., Houston, TX (US)

( * ) Notice: Subject to any disclaimer, the term of this patent is extended or adjusted under 35 U.S.C. 154(b) by 170 days.

(21) Appl. No.: 11/257,294

(22) Filed: Oct. 24, 2005

(65) Prior Publication Data

US 2007/0089908 A1 Apr. 26, 2007

(51) Int. Cl.
*E21B 10/36* (2006.01)

(52) U.S. Cl. ..... 175/325.2; 173/133

(58) Field of Classification Search ..... 175/57, 175/295, 414, 325.2; 173/133
See application file for complete search history.

(56) References Cited

U.S. PATENT DOCUMENTS 2,855,052 A * 10/1958 Wright et al. ..... 166/243
2,942,579 A * 6/1960 Morrison ..... 173/138
3,322,216 A 5/1967 Kurt
3,343,890 A * 9/1967 Homer ..... 175/325.2
5,390,749 A * 2/1995 Lyon ..... 175/296
5,562,170 A * 10/1996 Wolfer et al. ..... 175/296
5,803,192 A 9/1998 Holte
6,464,023 B2 * 10/2002 Patterson ..... 175/93
6,516,903 B2 * 2/2003 Rogers ..... 175/300
6,789,632 B2 * 9/2004 Green ..... 175/300

* cited by examiner

*Primary Examiner*—David Bagnell
*Assistant Examiner*—Daniel P Stephenson
(74) *Attorney, Agent, or Firm*—Osha Liang, LLP

(57) ABSTRACT

A bit retainer system is disclosed. The bit retainer system includes a bit having a head and a shank, a driver sub disposed around the shank of the bit and adapted to engage a hammer case, a bit retainer disposed around the shank of the bit and abutting an upper end of the driver sub, and a secondary retainer disposed around the bit retainer.

11 Claims, 9 Drawing Sheets

SECONDARY RETAINER FOR A DOWNHOLE HAMMER BIT

BACKGROUND OF INVENTION

1. Field of the Invention

The invention relates generally to percussion, or hammer, bits. More specifically, the invention relates to a secondary retainer for a downhole hammer bit.

2. Background Art

Percussion bit systems are often used in drilling or boring through the earth's surface. In a percussion bit system, a percussion hammer is used to drive the percussion bit into the ground using the reciprocating action of a piston to energize the bit.

FIG. 1 illustrates a conventional percussion bit assembly design 100. Percussion hammer assembly 100 comprises a hammer case 101 that connects to a lower end of a drill string (not shown) through a threaded pin connection 145. The lower end of the hammer case 101 is threadedly engaged with driver sub 102. A plurality of splines (not shown) disposed on the driver sub 102, engage a plurality of splines 115 disposed on a shank 112 of a hammer bit 110, and rotatatively drive the bit 110. A retainer, conventionally a split ring, 113 is disposed around an upper end of the shank 112 of the hammer bit 110 and abuts the driver sub 102. The split ring 113 retains the hammer bit 110 in the hammer assembly 100. The split ring 113 may be held in place, initially, by an elastic ring, or o-ring, 116 to facilitate assembly of the bit and driver sub with the hammer case. The split ring is confined by the inner wall of the hammer case 101 to maintain ring-to-bit engagement. The upper end of the hammer bit 110 includes a piston strike surface 148 and a foot valve, or blow tube, 147. The lower end of the hammer bit includes a head 111.

The hammer assembly includes a control tube 143 and an annular piston chamber 146. Pressurized air moves a piston 142 in a reciprocating motion inside the annular piston chamber 146. A check valve 144 is used to communicate one-way flow between the control tube 143 and the drill string (not shown). The lower end of the piston 142 is adapted to strike the piston strike surface 148, thereby imparting kinetic energy to the bit 110.

During certain operations performed with a hammer tool, it may be necessary to reverse drill pipe rotation, thereby causing the driver sub 102 to back off, or unthread, from the hammer case 101. Occasionally, a driver sub will unintentionally back off downhole due to torsional oscillations, known as "stick-slip", of the drill string. If the driver sub backs off, the bit 110 and the driver sub 102 remain at the bottom of the borehole. When this occurs, the elastic ring 116 that restricts the movement of the split ring 113 during installation often fails and permits the split ring to fall away out of engagement with the bit. Consequently, the split ring does not fulfill the function of retaining the bit in the driver sub assembly. Therefore, when the driller attempts to screw back into the driver sub with the hammer case, the bit is left in the hole when the hammer is extracted. Sometimes the split ring segments lodge in between the driver sub 102 and the borehole wall, preventing the hammer case 101 from screwing back over the driver sub 102. The bit left in the hole has to be retrieved later through a costly fishing operation.

A segmented retainer sleeve 24, as shown in FIGS. 2 and 3 can be used to retain the bit 210 to the driver sub assembly after a driver sub backs off. FIGS. 2 and 3 show a conventional hammer assembly 200 comprising a driver sub 202, a segmented retainer sleeve 24, a hammer case 201, and a bit 210. U.S. Pat. No. 5,803,192 shows an example of such a conventional bit retainer.

The segmented retainer sleeve 24, as shown in FIGS. 2 and 3, includes a ring portion 24A, which seats about a reduced diameter segment 25 of the bit 210. Ring portion 24A, in combination with shoulder 24B, limits reciprocal travel of the drill bit 210. Skirt extension 26 has a lesser wall thickness than the ring portion 24A and slidably engages the bit 210. Skirt extension 26 nests within a counterbore 27 shown formed in the upper end of the driver sub 202. During a drilling operation, should the driver sub 202 back off, the segmented retainer sleeve 24 should remain in place about the bit because the skirt extension 26 is radially confined. Joining the hammer case 201 with the driver sub 202 after the driver sub 202 backs off may be accomplished by rotating the hammer case 201 on the driver sub 202. A drawback of this design is that, as a result of the counterbore 27 in the driver sub 202, the spline contact area between the splines 33 on the driver sub and the splines (not shown) on the bit 210 is reduced. A reduction in the spline contact area may result in rapid wear and breakage of the splines.

Accordingly, there exists a need for a downhole hammer bit retainer that retains the bit within the driver sub in the event the driver sub backs off downhole and that maintains the mechanical integrity of the driver sub and drill bit.

SUMMARY OF INVENTION

In one aspect, the invention relates to a bit retainer system. In one embodiment of the invention, the bit retainer system includes a bit having a head and a shank, a driver sub disposed around the shank of the bit and adapted to engage a hammer case, a bit retainer disposed around the shank of the bit and abutting an upper end of the driver sub, and a secondary retainer disposed around the bit retainer.

In another aspect, embodiments of the present invention relate to a method of assembling a bit retainer system. In one embodiment, method includes disposing a driver sub over a drill bit, assembling a bit retainer around the shank of the drill bit and abutting the driver sub, installing a secondary ring around the bit retainer, deforming the secondary retainer, and assembling the drill bit and driver sub into the hammer case.

In another aspect, embodiment of the present invention relate to an apparatus to secure a segmented retainer ring in a downhole tool. In one embodiment, the apparatus includes a perforated metallic deformable ring configured to surround an outer profile of the segmented retainer ring, the outer defining a circumferential groove, wherein the perforated metallic band is configured to be plastically deformed into the circumferential groove.

Other aspects and advantages of the invention will be apparent from the following description and the appended claims.

DETAILED DESCRIPTION

When using a hammer drill, the driller may back off the driver sub, or occasionally; the driver sub may back off unintentionally. As used herein, the term "back off" means to unscrew drillstring components downhole. The drillstring components, which may include a drillpipe, a bottomhole assembly, a driver sub, etc., are coupled by various threadforms known as connections, or tool joints. Any of these drillstring components may unthread or back off. When a drillstring becomes stuck, the driver sub may unintentionally back off downhole, or it may be necessary to intentionally back off the drillstring from the driver sub to recover as much of the drilling string as possible. The back off may be intentionally accomplished by applying reverse torque and detonating an explosive charge inside a selected threaded connection. Alternatively, the back off may be intentionally accomplished by applying tension to the drillstring and detonating an explosive charge, thereby allowing the threads to slide by each other without turning. When a driver sub backs off, a bit retainer, usually a split ring configured to retain a drill bit in the driver sub during assembly, often separates from a bit shank. Accordingly, the split ring no longer performs the function of retaining the bit in the driver sub. Thus, when the driller attempts to screw back into the driver sub with the hammer case, the bit is left in the hole. In the event the bit head is lost in the hole, it may be necessary to cement the original wellbore and sidetrack. Sidetracking, or drilling a secondary wellbore away from an original wellbore, is an expensive operation and may cost around 20,000 to 50,0000 dollars. Additionally, this results in a hole which thereafter has an undesirable dogleg. In one aspect, embodiments of the present invention relate to a secondary retainer for retaining the bit retainer to the drill bit.

Select embodiments of the present invention, as described below, include a bit retainer system. In one embodiment, the bit retainer system comprises a secondary retainer disposed around a bit retainer. In some embodiments, the secondary retainer comprises a perforated metallic deformable ring. The bit retainer is disposed around an upper end of a bit shank and abuts a driver sub. In some embodiments, the bit retainer comprises a segmented retainer ring. In the event the driver sub backs off the hammer assembly, a secondary retainer retains the segmented retainer ring to the drill bit shank. When the driller attempts to thread the hammer back on to the driver sub, the drill bit is retained in the driver sub, and the entire assembly may be reconnected to the hammer. Embodiments of the bit retainer system of the present invention may prevent the loss of a drill bit at the bottom of the hole and may prevent costly fishing operations to recover lost drill bits.

Figure 1:
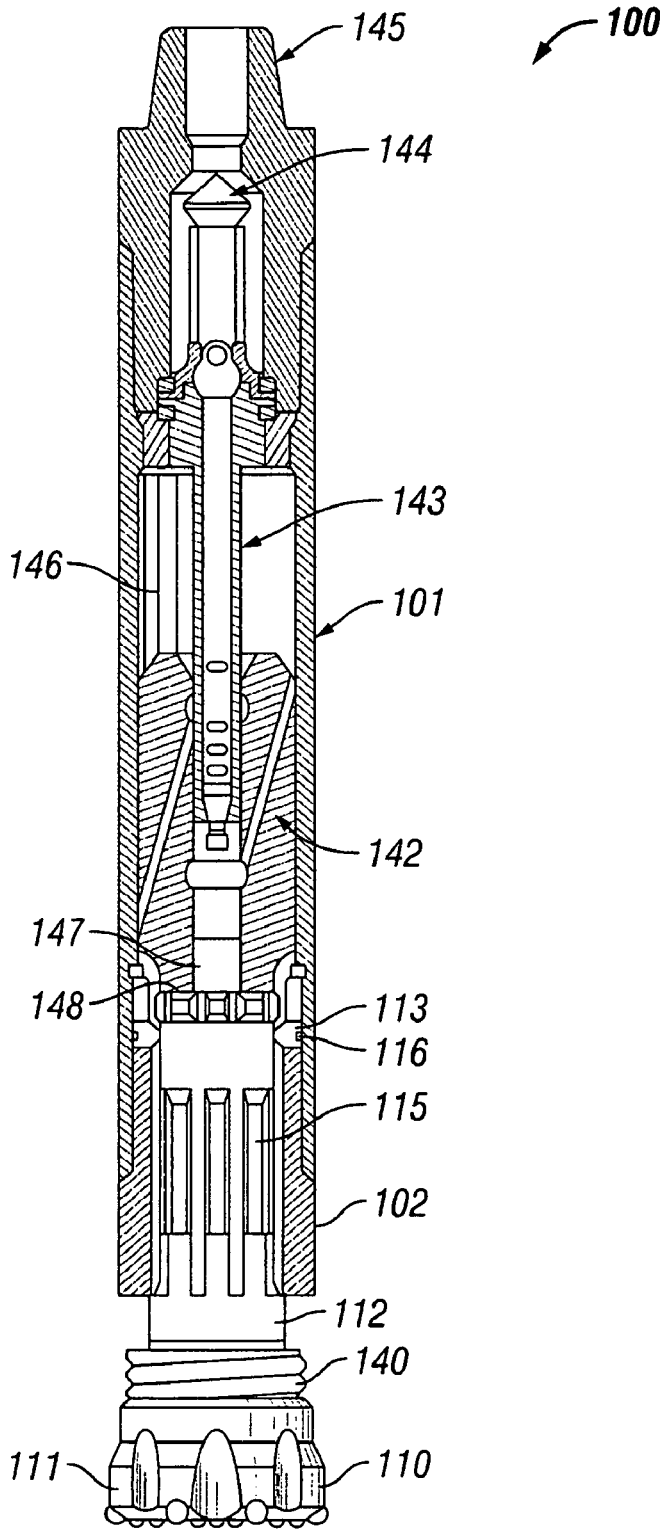
FIG. 1 (Prior Art)
FIG. 1 shows a cross-sectional view of a conventional hammer bit system design.
Figure 2:
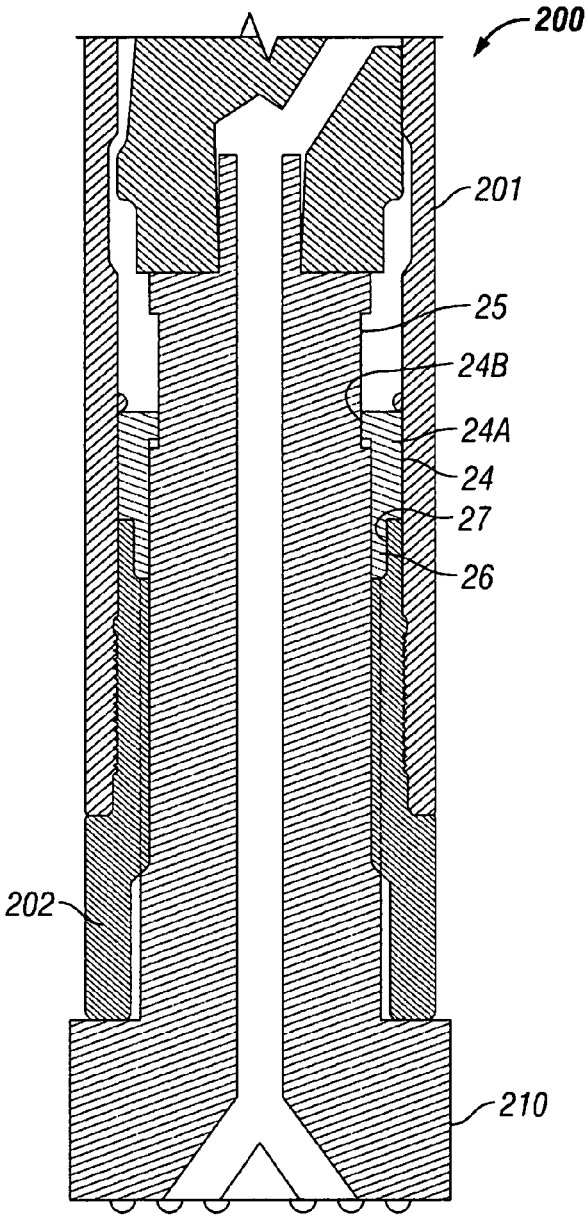
FIG. 2 (Prior Art)
FIG. 2 shows a cross-sectional view of a conventional drill bit retainer design.
Figure 3:
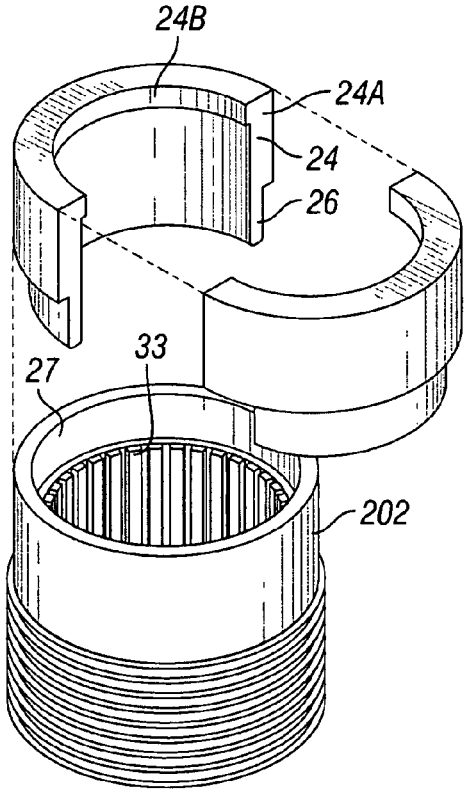
FIG. 3 (Prior Art)
FIG. 3 shows a cross-sectional view of a conventional drill bit retainer design.
Figure 4:
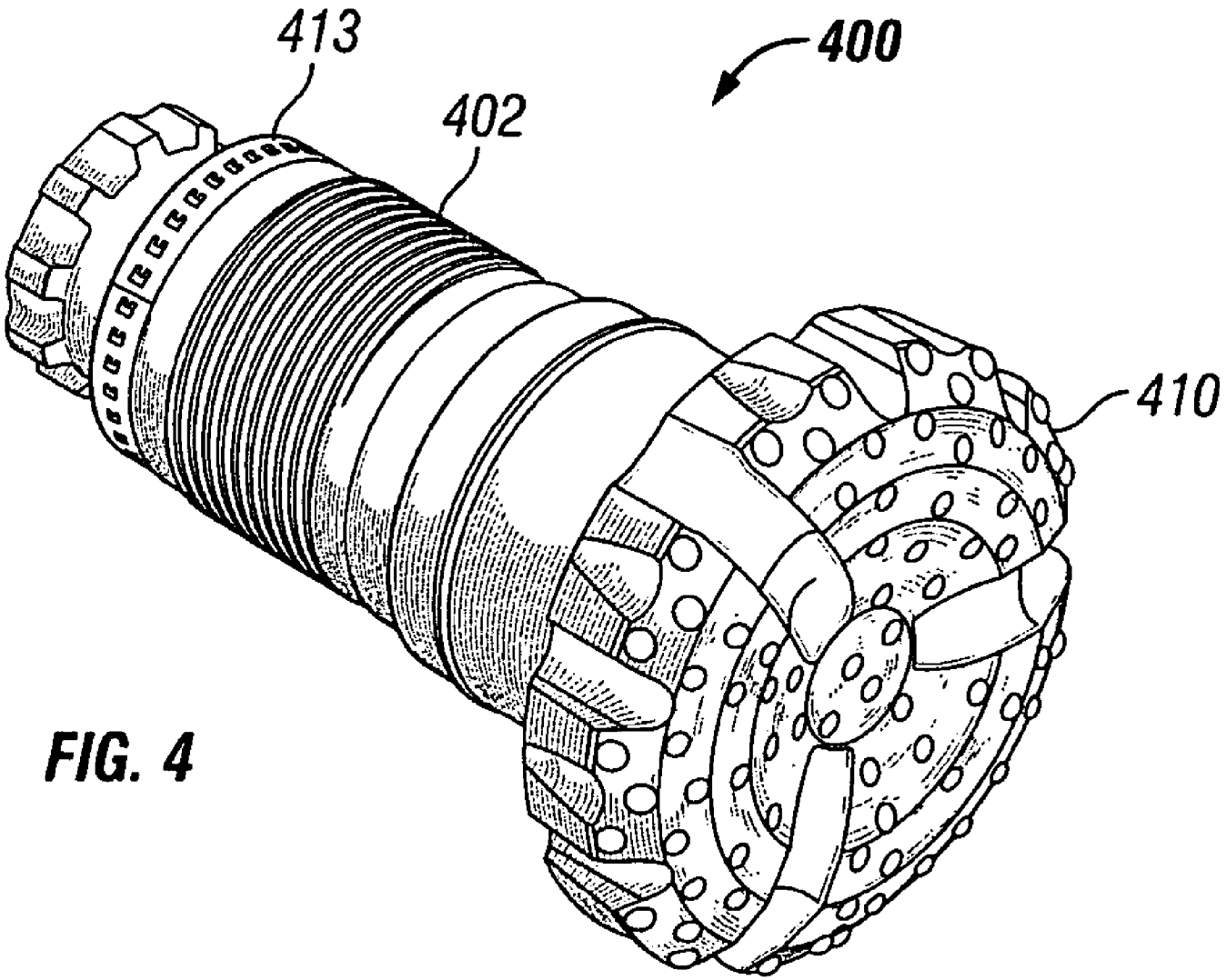
FIG. 4 shows a bit retainer system in accordance with an embodiment of the resent invention.

FIG. 4 shows an assembled bit retainer system in accordance with an embodiment of the invention. In this embodiment, the bit retainer system 400 comprises a drill bit 410, a driver sub 402, a bit retainer (not shown), and a secondary retainer 413. In this embodiment, the secondary retainer 413 comprises a perforated metallic deformable ring. In select embodiments, the perforations may be tabs or webs.

Figure 5:
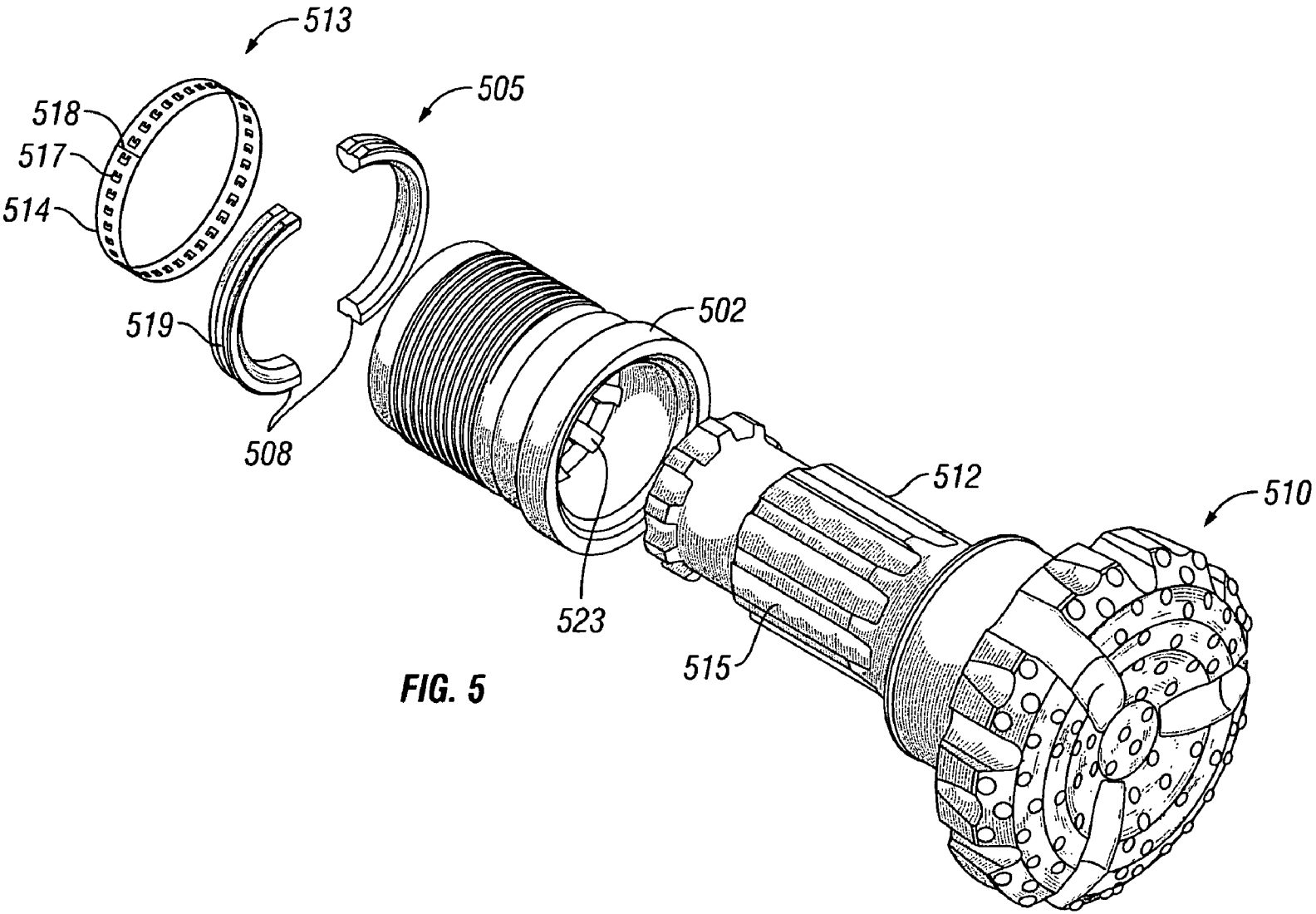
FIG. 5 shows a bit retainer system in accordance with another embodiment of the present invention.

FIG. 5 shows an exploded view of the bit retainer system of FIG. 4, in accordance with an embodiment of the invention. A driver sub 502 is disposed around a shank 512 of the bit 510. A plurality of splines 523 on the inside diameter of the driver sub 502 engage a plurality of splines 515 disposed axially on the outside diameter of shank 512 to rotatively drive the bit 510. In this embodiment, a bit retainer 505 comprises a segmented ring 508 disposed around shank 512 of the bit 510 and abutting the driver sub 502. A secondary retainer 513 is disposed around the bit retainer 505.

In this embodiment, the secondary retainer 513 comprises a perforated deformable ring 514. The perforated deformable ring 514 may be made from a flat strip of sheet metal that is punched to form a plurality of tabs 517 and then rolled and seam-welded 518. The plurality of tabs 517 are formed at selected locations around the circumference of the perforated deformable ring 514. One of ordinary skill in the art will appreciate that the number of tabs or webs formed and the selected locations of the tabs along the circumference of the perforated deformable ring may vary. The size, number, and location of the webs or tabs may depend on, for example, the dimensions of the drill bit or the load induced on the bit retainer and secondary retainer. In one embodiment, the plurality of tabs 517 align with a corresponding circumferential groove 519 formed in the bit retainer 505. In one embodiment, the circumferential groove 519 may be a continuous channel formed in the outside diameter of the bit retainer 505. In another embodiment, the circumferential groove 519 may be a series of grooves or notches that correspond to and align with the plurality of tabs 517.

After assembling the drill bit 510, driver sub 502, bit retainer 505, and the secondary retainer 513, the plurality of tabs 517 are plastically deformed inward, thereby engaging the circumferential groove 519 formed in the bit retainer 505. One of ordinary skill in the art will appreciate that the plurality of tabs 517 may be deformed by any method known in the art, for example, by pressing a screwdriver against tabs 517 to deform the tabs 517 radially inward. The engagement of the plurality of tabs 517 and the circumferential groove 519 secure the perforated deformable ring 514 to the bit retainer 505 and secure the bit retainer 505 in place around the bit 510. In the event the driver sub 502 backs off the hammer, the secondary retainer 513 retains the segmented ring 508 of the bit retainer 505 to the shank 512 of the bit 510. Accordingly, the drill bit 510 is retained inside the driver sub 502. The driller may recover the driver sub 502 and the drill bit 510 by reconnecting the hammer to the driver sub 502 by threading the hammer case (not shown) back onto the driver sub 502.

In accordance with an embodiment of the invention, the secondary retainer 513 may be removed from the bit retainer 505 by radially deforming the plurality of deformed webs radially outward, in the event the drill bit 510 needs to be replaced, or upon disassembly of the driver sub 502 and drill bit 510 from the hammer. The secondary retainer 513 may be reused, but this method may be time consuming. In accordance with an embodiment of the invention, the secondary retainer 513 may be cut off of the bit retainer 505 by aligning the area to be cut with the split of the segmented ring 508. In another embodiment, the plurality of tabs may be cut and pried apart, thereby allowing the secondary retainer 513 to be removed from the bit retainer 505.

Figures 6A, 6B:
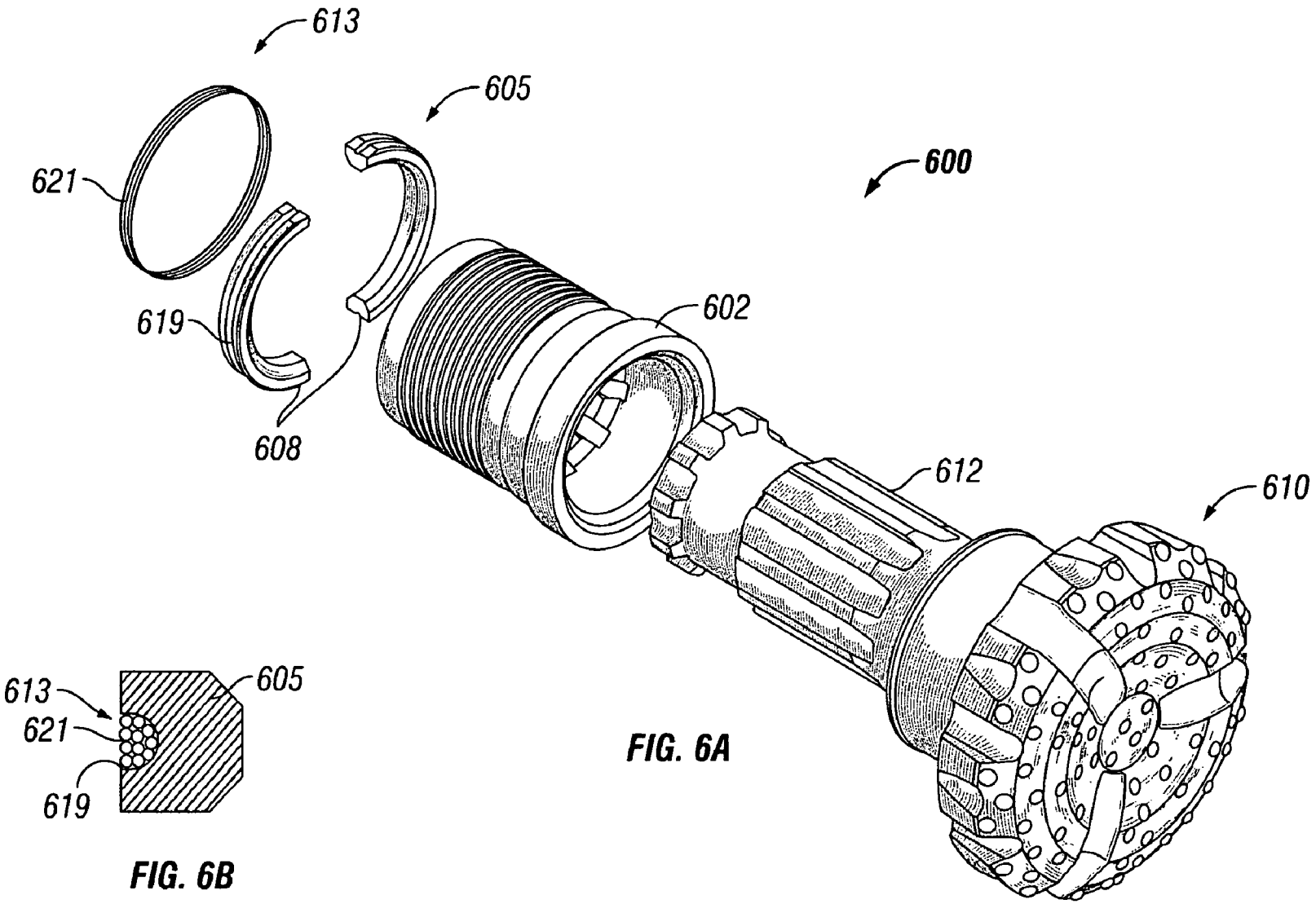
FIGS. 6A and 6B shows a bit retainer system in accordance with another embodiment of the present invention.

In another embodiment, as shown in FIG. 6A, the bit retainer system 600 comprises a drill bit 610, a driver sub 602, a bit retainer 605, and secondary retainer 613. In this embodiment, the bit retainer 605 comprises a segmented ring 608 and the secondary retainer 613 comprises a small gage wire 621. The small gage wire 621 is wrapped around the segmented ring 608 and disposed in a circumferential groove 619 on the outside diameter of the segmented ring 608. The small gage wire 621 retains the bit retainer 605 in its location around the drill bit in the event the driver sub backs off.

FIG. 6B shows a cross section view of a portion of the bit retainer system 600 of FIG. 6A. In this embodiment, the secondary retainer 613 comprises a small gage wire 621 wrapped around a bit retainer 605 and disposed in a circumferential groove 619 formed on the outside diameter of the bit retainer 605. In one embodiment, the ends (not shown) of the small gage wire 621 may be twisted around each other to prevent the small gage wire 621 from separating from the bit retainer 605. One of ordinary skill in the art will appreciate that the size of the wire and the number of wraps of wire may vary depending on, for example, the dimensions of the drill bit or the dimensions of the bit retainer.

Figure 7:
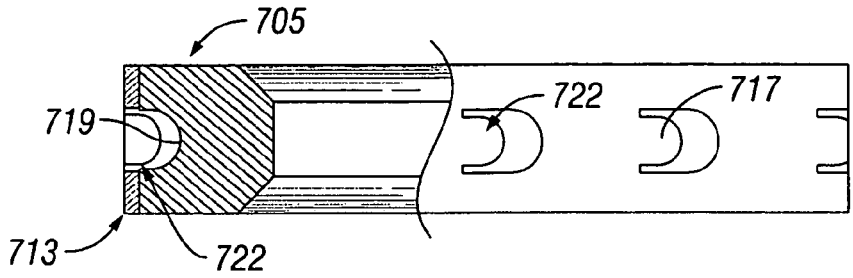
FIG. 7 shows a side view and a partial cross-section view of a bit retainer system in accordance with an embodiment of the present invention.

In another embodiment, a secondary retainer in accordance with the present invention may be formed as shown in FIG. 7, wherein a secondary retainer 713 is formed with a plurality of tabs 717 and is disposed around bit retainer 705. A circumferential groove 719 is formed in the outside diameter of bit retainer 705. Once the secondary retainer 713 is assembled around the bit retainer 705, the plurality of tabs 717 are plastically deformed inward 722 and engage the circumferential groove 719. One of ordinary skill in the art will appreciate that the plurality of tabs 717 may be deformed by any method known in the art, for example, by pressing a screwdriver against tabs 717 to deform the tabs 717 radially inward. In one embodiment, as shown in FIG. 7, the tabs 717 may be formed in a hemispherical or crescent-like shape with a corresponding hemispherical or crescent-like shaped opening. The shape of the tabs is not limited to that shown in FIG. 7. One of ordinary skill in the art will appreciate that any shape tab that may be plastically deformed inward to engage a groove on the bit retainer may be used, without departing from the scope of the invention. For example, a rectangular shaped tab or a circular shaped tab may be used.

Figure 8A:
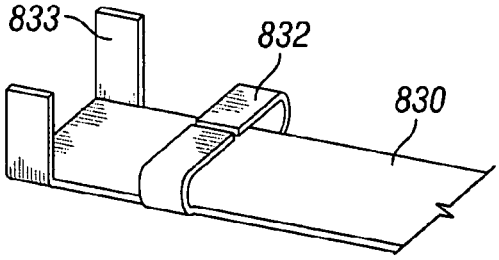
FIGS. 8A, 8B, and 8C show a bit retainer system in accordance with another embodiment of the present invention.
Figure 8B:
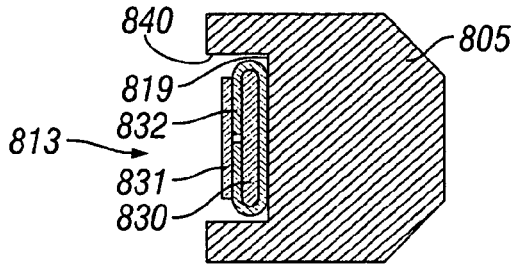
Figure 8C:
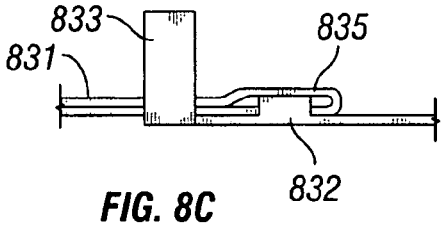

In another embodiment, as shown in FIGS. 8A, 8B, and 8C, a secondary retainer comprises a band 830 with a buckle 832 formed into the band. As shown in FIG. 8A, the buckle 832 may be integrally formed into the band 830. One of ordinary skill in the art will appreciate, however, that the buckle may be attached by means such as welding, riveting, crimping, or other similar means. FIG. 8B shows a cross-section view taken through the assembled buckle and part of the bit retainer 805. The bit retainer 805 may be a segmented ring similar to the bit retainer 605 shown in FIG. 6A. In this embodiment, the band 830 is placed in the circumferential groove 819 of the bit retainer 805 and wrapped around the bit retainer 805. The end 831 of the band 830 is then threaded through the buckle 832 and folded back, shown at 835, over the buckle 832. The band is then secured by at least one deformable tab 833, as shown in FIG. 8C. The at least one deformable tab 833 is plastically deformed over the end 832 of the band 830. As shown in FIG. 8B, the band 830 and buckle 832 may be protected from damage during handing and in use through at least one lip 840 formed into the bit retainer 805. The band 830 retains the bit retainer 805 to the bit (not shown), thereby preventing separation of the bit from the driver sub (not shown) in the event the driver sub backs off.

Figure 9:
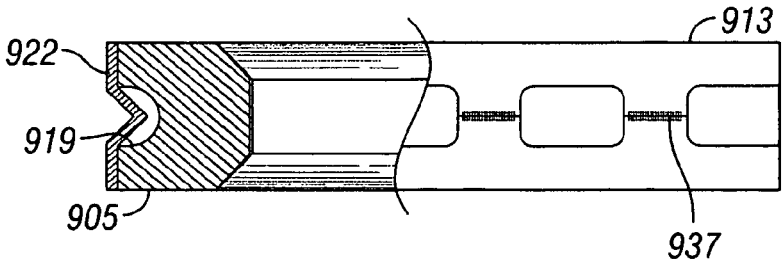
FIG. 9 shows a side view and a partial cross-section view of a bit retainer system in accordance with an embodiment of the present invention.

In another embodiment, shown in FIG. 9, a secondary retainer 913 formed with a plurality of webs 937 is disposed around bit retainer 905. A circumferential groove 919 is formed in the outside diameter of bit retainer 905. Once the secondary retainer 913 is assembled around the bit retainer 905, the plurality of webs 937 are plastically deformed inward 922 and engage the circumferential groove 919. In the embodiment shown in FIG. 9, the plurality of webs 937 may be formed by punching holes into a flat strip of sheet metal. The punched strip of sheet metal may then be rolled and seam-welded. The shapes of the holes punched and the corresponding tabs are not limited to that shown in FIG. 9. One of ordinary skill in the art will appreciate that any shape punch or web may be used without departing from the scope of the invention so long as the webs may be plastically deformed inward to engage a groove on the bit retainer. One of ordinary skill in the art will appreciate that the plurality of webs 937 may be deformed by any method known in the art, for example, by pressing a screwdriver against the webs 937 to deform the webs 937 radially inward.

Figure 10A:
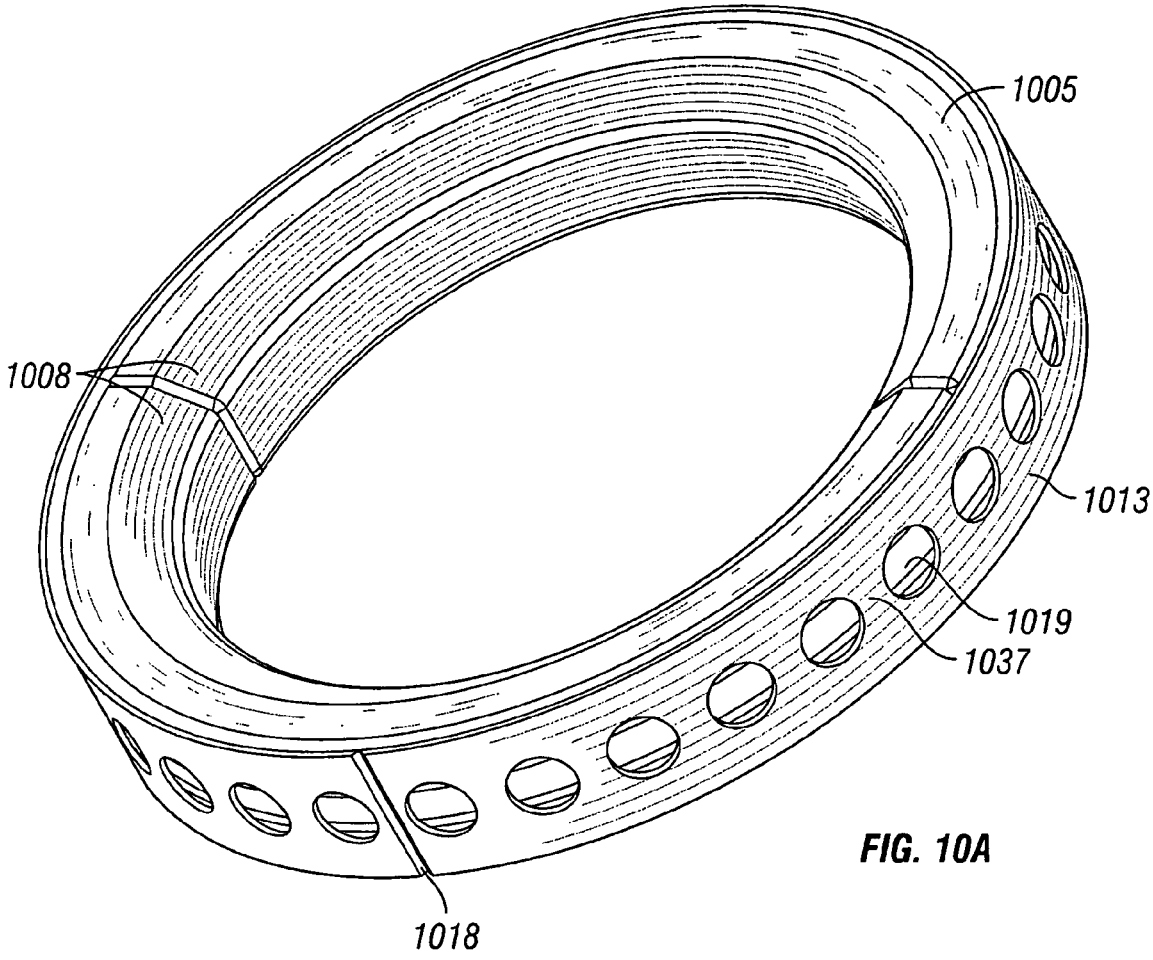
FIGS. 10A and 10B show a bit retainer system in accordance with the embodiment of FIG. 9.
Figure 10B:
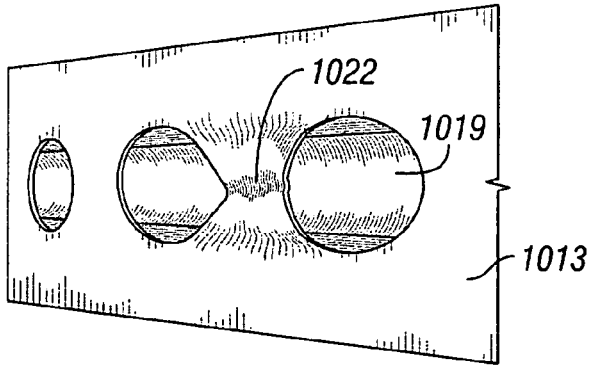

FIG. 10A shows a perspective view of a secondary retainer 1013, formed in accordance with the embodiment shown in FIG. 9, disposed around a bit retainer 1005. Bit retainer 1005 comprises a split ring 1008. Secondary retainer 1013 is formed from a flat strip of sheet metal that is punched to form a plurality of webs 1037, rolled, and seam-welded 1018. The plurality of webs 1037 are then deformed radially inward 1022, shown in FIG. 10B, thereby engaging a circumferential groove 1019 on the bit retainer 1005.

Figure 11:
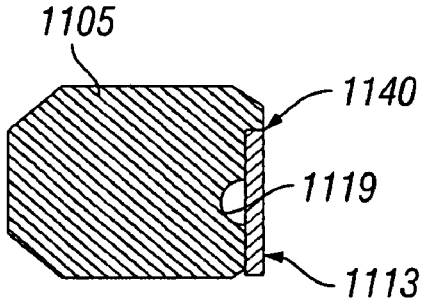
FIG. 11 shows a partial cross section view of a bit retainer system in accordance with another embodiment of the present invention.

In another embodiment, shown in FIG. 11, a secondary retainer 1113 is disposed around the outside diameter of the bit retainer 1105. In this embodiment, the secondary retainer 1113 abuts a lip 1140 formed in the bit retainer 1105. The lip 1105 protects the retainer ring 1113 from being displaced or damaged during assembly of the driver sub and drill bit into the hammer case. The secondary retainer 1113 may contain a plurality of webs or tabs formed so as to be deformed inward to engage the circumferential groove 1119 formed on the outside diameter of the bit retainer 1105.

Figure 12A:
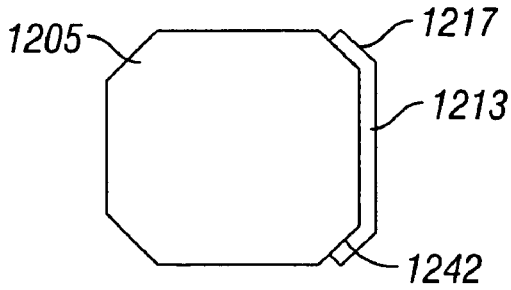
FIGS. 12A, 12B, and 12C show a bit retainer system in accordance with another embodiment of the present invention.
Figure 12B:
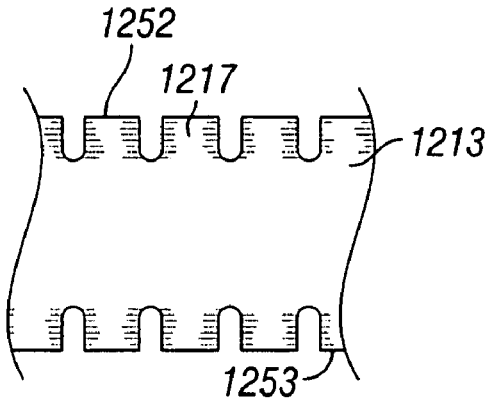
Figure 12C:
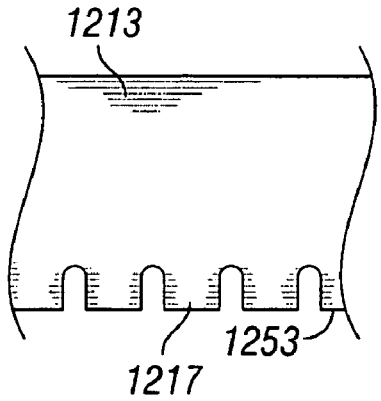

In another embodiment, shown in FIGS. 12A-12C, a secondary retainer 1213 may be formed from a flat strip of sheet metal formed with a plurality of tabs 1217 disposed on at least one circumferential edge 1252, 1253. The flat strip of metal may then be rolled and seam-welded. As shown in FIG. 12B, the plurality of tabs 1217 may be disposed on both circumferential edges 1252, 1253 of the secondary retainer 1213, or as shown in FIG. 12C, the plurality of tabs 1217 may be formed on one circumferential edge 1253. The secondary retainer 1213 is disposed around a bit retainer 1205. In this embodiment, the plurality of tabs 1217 are deformed inward to engage with a corresponding angled surface 1242 on the bit retainer 1205.

Figure 13:
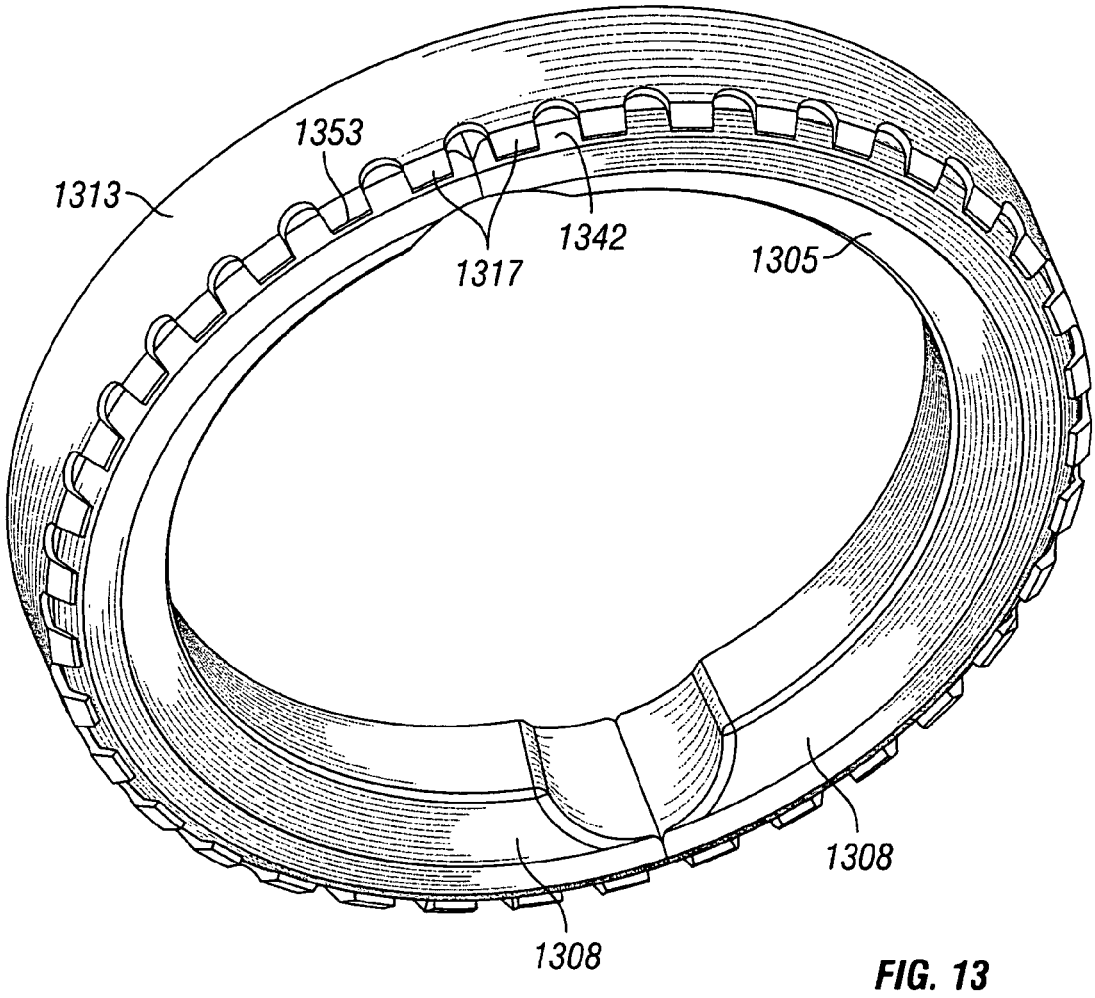
FIG. 13 shows a bit retainer system in accordance with the embodiment of FIGS. 12A, 12B, and 12C.

FIG. 13 shows a perspective view of a secondary retainer 1313, formed in accordance with the embodiment shown in FIGS. 12A-12C, disposed around a bit retainer 1305. Bit retainer 1305 comprises a split ring 1308. Secondary retainer 1313 is formed with a plurality of tabs 1317 formed on one circumferential edge 1353. The plurality of tabs 1317 are deformed radially inward and engage with a corresponding angled surface 1342 on the bit retainer 1305. The secondary retainer 1313 engages with the bit retainer 1305 such that, in the event the driver sub backs off, the secondary retainer 1313 retains the segmented rings of the bit retainer in place around the drill bit. Accordingly, when the driver sub is reconnected to the hammer, the drill bit remains assembled to the driver sub.

Embodiments of the invention may include one or more of the following advantages. A bit retainer system with a secondary retainer to retain the bit retainer in a position necessary for retaining the bit to the driver sub during assembly of the hammer. A bit retainer system with a secondary retainer to retain the bit retainer in a position necessary for retaining the bit to the driver sub in the event the driver sub backs off. Accordingly, the bit retainer system may decrease the time for recovering a driver sub and drill bit. Additionally, the bit retainer system may decrease the cost of reconnecting the driver sub and drill bit to the hammer after the driver sub backs off.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A bit retainer system comprising:

a bit having a head and a shank;

a driver sub disposed wound the shank of the bit and adapted to engage a hammer case;

a bit retainer disposed around the shank of the bit and abutting an upper end of the driver sub; and a secondary retainer comprising a band disposed around the bit retainer and a buckle;

wherein at least one of the group consisting of the buckle and the band is plastically deformed to secure the band.

2. The bit retainer system of claim 1, wherein the bit retainer comprises a segmented retainer ring.

3. The bit retainer system of claim 2, wherein the segmented retainer ring comprises a circumferential groove on the outside diameter of the segmented retainer ring.

4. The bit retainer system of claim 1, wherein the band comprises at least one deformable tab, and wherein an end of the band is inserted through the buckle and deformed back over the buckle.

5. The bit retainer system of claim 4, wherein the at least one deformable tab is plastically deformed over the end of the band.

6. The bit retainer system of claim 1, wherein the bit retainer comprises a lip.

7. The bit retainer system of claim 6, wherein the secondary retainer abuts the lip of the bit retainer.

8. A bit retainer system comprising:

a bit having a head and a shank;

a driver sub disposed around the shank of the bit and adapted to engage a hammer case;

a bit retainer disposed around the shank of the bit and abutting an upper end of the driver sub; and a secondary retainer comprising a deformable ring disposed around the bit retainer;

wherein the deformable ring comprises a plurality of tabs disposed at select locations along the deformable ring; and wherein the plurality of tabs are configured to deform radially inward and engage a circumferential groove on the outside of the bit retainer ring.

9. A bit retainer system comprising:

a bit having a head and a shank;

a driver sub disposed around the shank of the bit and adapted to engage a hammer case:

a bit retainer disposed around the shank of the bit and abutting an upper end of the driver sub, and;

a secondary retainer disposed wound the bit retainer;

wherein the bit retainer comprises a segmented retainer ring including a circumferential groove on the outside diameter; and wherein the secondary retainer comprises small gage wire wrapped around the segmented retainer ring in the circumferential groove.

10. A bit retainer system comprising:

a bit having a head and a shank;

a driver sub disposed around the shank of the bit and adapted to engage a hammer case:

a bit retainer disposed around the shank of the bit and abutting an upper end of the driver sub; and a secondary retainer disposed around the bit retainer;

wherein the secondary retainer comprises a deformable ring formed with a plurality of deformable tabs on at least one circumferential edge.

11. The bit retainer system of claim 10, wherein the plurality of deformable tabs are deformed inward and engage a corresponding angled surface on the bit retainer.

* * * * *

UNITED STATES PATENT AND TRADEMARK OFFICE

CERTIFICATE OF CORRECTION

PATENT NO. : 7,343,989 B2
APPLICATION NO. : 11/257294
DATED : March 18, 2008
INVENTOR(S) : Lance Underwood It is certified that error appears in the above-identified patent and that said Letters Patent is hereby corrected as shown below:

In the Claims:

In Claim 1, column 7, line 37, the word "wound" should be --around--.

In Claim 9, column 8, line 28, the word "wound" should be --around--.

Signed and Sealed this

First Day of July, 2008

JON W. DUDAS
*Director of the United States Patent and Trademark Office*